United States Patent [19]

Resener

[11] Patent Number: 4,576,031

[45] Date of Patent: Mar. 18, 1986

[54] QUICK DISCONNECT ARBOR AND DIE HEAD FOR TUBE STOCK SIZING APPARATUS

[75] Inventor: Kenneth L. Resener, Indianapolis, Ind.

[73] Assignee: Resener Machine & Tool Co., Inc., Indianapolis, Ind.

[21] Appl. No.: 688,068

[22] Filed: Dec. 31, 1984

[51] Int. Cl.[4] ..... B21D 22/00

[52] U.S. Cl. ..... 72/355; 72/370; 72/399; 72/401

[58] Field of Search ..... 72/355, 399, 370, 401

[56] References Cited

U.S. PATENT DOCUMENTS 2,828,538 4/1958 Darden ..... 72/355

3,049,034 8/1962 Resener ..... 72/399

*Primary Examiner*—Leon Gilden

*Attorney, Agent, or Firm*—Woodard, Weikart, Emhardt & Naughton

[57] ABSTRACT

A quick disconnect arbor and die head for a tube stock sizing apparatus. A plurality of arbors and die heads are slidably mounted to a tube stock sizing apparatus and are respectively urged into engagement with the inwardly facing and outwardly facing surfaces of a section of tube stock. A hydraulic piston arrangement is operable to move the arbor members and die heads to and from the tube stock. An annular member surrounds the arbor members and die heads. Spring biased pins mounted in the annular member releasably engage and secure the arbor members to the annular member. An external tool is engageable with the top end of each pin to pull the pins upwardly disengaging the arbor members. A rod extends through the annular member and contacts the pin and secures the pin in the upward disengaged position. Each die head includes a leg with a recess extending freely into a hole. A rod extends into the hole and is arranged perpendicularly to the leg and extends through the recess releasably holding the leg and die head to the annular member.

7 Claims, 8 Drawing Figures

QUICK DISCONNECT ARBOR AND DIE HEAD FOR TUBE STOCK SIZING APPARATUS

BACKGROUND OF THE INVENTION

This invention relates generally to sizing apparatus for metal parts of relatively thin cross-section and in particular to an apparatus for accurately sizing the tube stock.

In the manufacture of products which incorporate relatively thin-walled metal tubing, it is often necessary to use tubing having certain portions sized to close tolerances of the order of 0.005 inch. Such close tolerances are required, for example, on portions of automobile tail pipes. Applications wherein one portion of a tube must be telescoped into a second tube are further examples requiring close tolerances on the interfitting tube sections.

An apparatus for sizing tube stock to close tolerances is disclosed and claimed in U.S. Pat. No. 3,049,034 which is herewith incorporated by reference. Such apparatus includes slidably mounted arbor members and die heads which respectively contact the interior surface and exterior surface of the end portion of a tube to be sized to close tolerances. In the aforementioned patent, both the arbor members and die heads are mounted to the apparatus by bolts. As such, the bolts must first be removed necessitating waste of time whenever it is desirable to remove the arbors or die heads. Disclosed herein is a quick disconnect structure and tools to facilitate removal of the arbors and die heads in a relatively quick and easy manner as compared to the previously utilized bolt structure.

SUMMARY OF THE INVENTION

One embodiment of the present invention is a tube stock sizing apparatus comprising a stationary annular member, a plurality of spaced finger members for movement toward and away from the central axis of the annular member and spring biased toward the axis, the finger members extending parallel to the annular member axis with their outer surfaces being adapted to engage the inner bore of a section of tube stock to be sized, the inner surfaces of the finger members being inclined, spring biased quick disconnect means releasably engageable with the finger members and operable to mount the finger members to the annular member, a tapered spindle extending centrally through the finger members and engaging the inclined inner surfaces thereof, the spindle being movable along the axis of the annular member to displace the finger elements outwardly therefrom and into engagement with the tube stock, a plurality of spaced die elements for movement toward and away from the central axis of the annular member and spring biased away from the axis, the inner surfaces of the die elements being adapted to engage the outer surface of a section of tube stock to be sized, the outer surfaces of the die elements being inclined, removable tool means releasably engageable with the die elements and operable to mount the die elements to the annular members, a ring member encircling the annular member and having an inclined inner surface engaging the inclined outer surfaces of the die elements, the ring member being movable along the axis of the annular member to displace the die elements inwardly toward the axis and into engagement with the tube stock, and means for moving the spindle and the ring member independently of each other, the means comprising a hydraulic cylinder centrally divided into a first and second working chamber and mounted coaxially with the stationary annular member, a piston in the first chamber having an operative connection to the spindle, a piston in the second chamber having an operative connection to the ring member.

Another embodiment of the present invention is a tube stock sizing apparatus with quick disconnect arbor and die heads comprising a stationary annular member with a central, longitudinally extending axis, a plurality of spaced arbor members mounted to the annular member and spring biased for movement toward the central axis of the annular member and having outwardly facing surfaces adapted to engage the inner bore of a section of tube stock to be sized, pin means mounted to the annular member and spring biased into the arbor members to secure the arbor members to the annular member but yieldable to allow disengagement from the annular member and unmounting of the arbor members from the annular member, a plurality of die heads mounted to the annular member and spring biased for movement away from the central axis of the annular member and having engaging surfaces adapted to engage the outer surface of a section of tube stock to be sized, removable elongated member means extending longitudinally in the direction of the axis and being releasably mounted to the die heads to hold at least a portion thereof to the annular member, a tapered spindle extending centrally through the arbor members and engaging the inwardly facing surfaces thereof, the spindle being movable along the axis of the annular member to displace the arbor members outwardly therefrom and into engagement with the tube stock, and a ring member encircling the annular member and having an inner surface engaging the die heads and being movable along the axis of the annular member to displace the die heads inwardly toward the axis and into engagement with the tube stock.

A further embodiment of the present invention is a tube stock sizing apparatus comprising a stationary annular member, a plurality of spaced finger members supported by the annular member for movement toward and away from the central axis of the annular member, the finger members extending parallel to the annular member axis with their outer surfaces being adapted to engage the inner bore of a section of tube stock to be sized, the inner surfaces of the finger members being inclined, a tapered spindle element extending centrally through the finger members and engaging the inclined inner surfaces thereof, the spindle element being movable along the axis of the annular member to displace the finger elements outwardly therefrom and into engagement with the tube stock, a plurality of spaced die elements supported by the annular member for movement toward and away from the central axis of the annular member, the die members having legs with recesses, the inner surfaces of the die elements being adapted to engage the outer surface of a section of tube stock to be sized, the outer surfaces of the die elements being inclined, elongated rods extending longitudinally in the direction of the axis and into the recesses releasably securing the die heads to the annular member, a ring member encircling the annular member and adapted to engage the inclined outer surfaces of the die elements, the ring member being movable along the axis of the annular member to displace the die elements inwardly toward the axis and into engagement with the tube stock, means for moving the spindle element and the ring member independently of each other, the means comprising a dual hydraulic cylinder, spring biased pins mounted to the annular member and normally urged into engagement with the finger members securing same thereto but yieldable to allow unmounting of the finger members from the annular member, rod means engageable with the spring biased pins to hold same away from the finger members.

It is an object of the present invention to provide a tube stock sizing apparatus including quick disconnect arbors and die heads.

A further object of the present invention is to provide a new and improved die head and arbor mounting structure.

In addition, it is an object of the present invention to provide a method and tools for quickly mounting and unmounting arbors and die heads on a tube stock sizing apparatus.

It is an object of the present invention to provide a quick disconnect structure for mounting the arbors and die heads of a tube stock sizing apparatus.

In addition, it is an object of the present invention to provide mounting means for securing an arbor and die head.

Related objects and advantages of the present invention will become apparent from the following description.

DESCRIPTION OF THE PREFERRED EMBODIMENT

Figure 1:
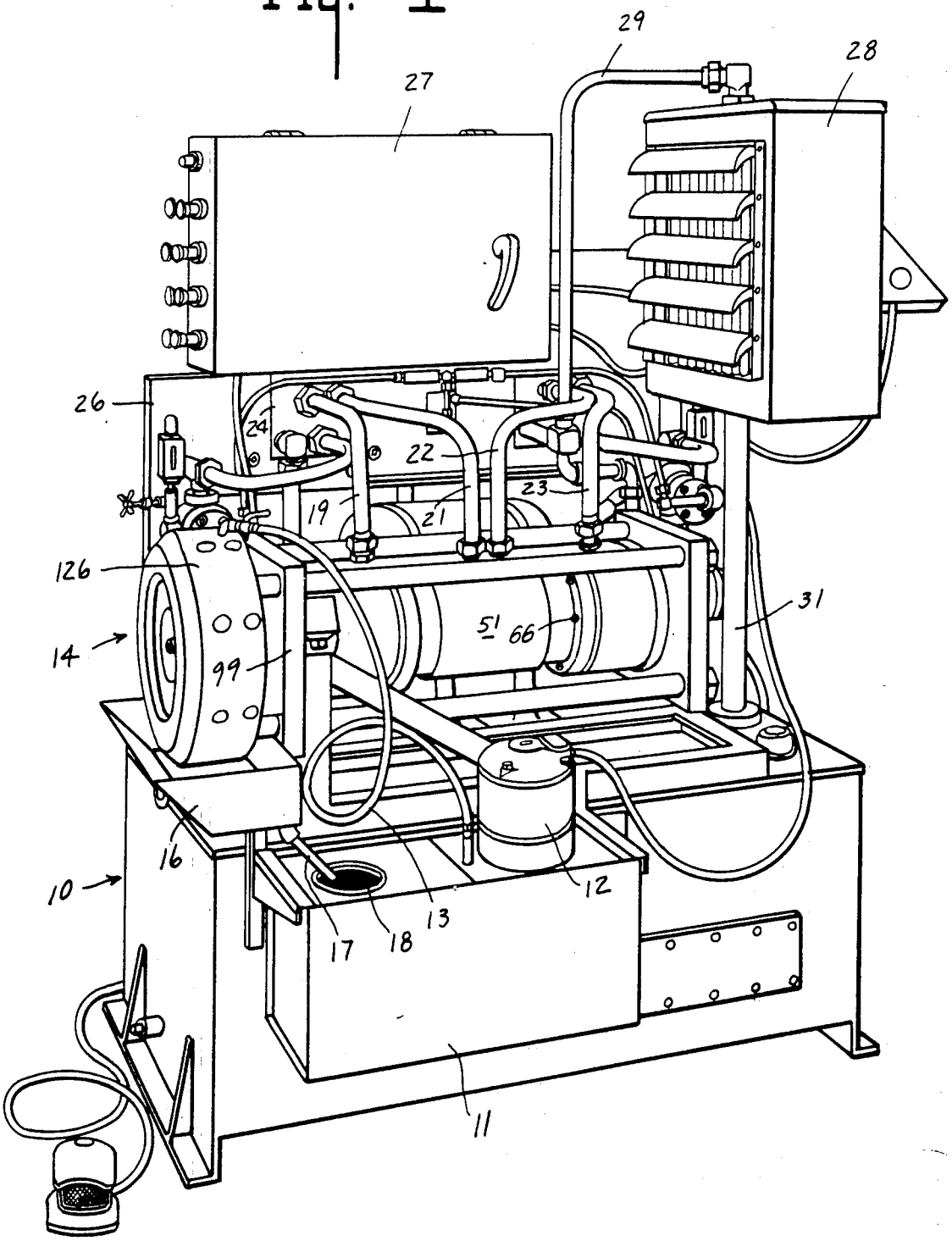
FIG. 1 is a perspective view of apparatus incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
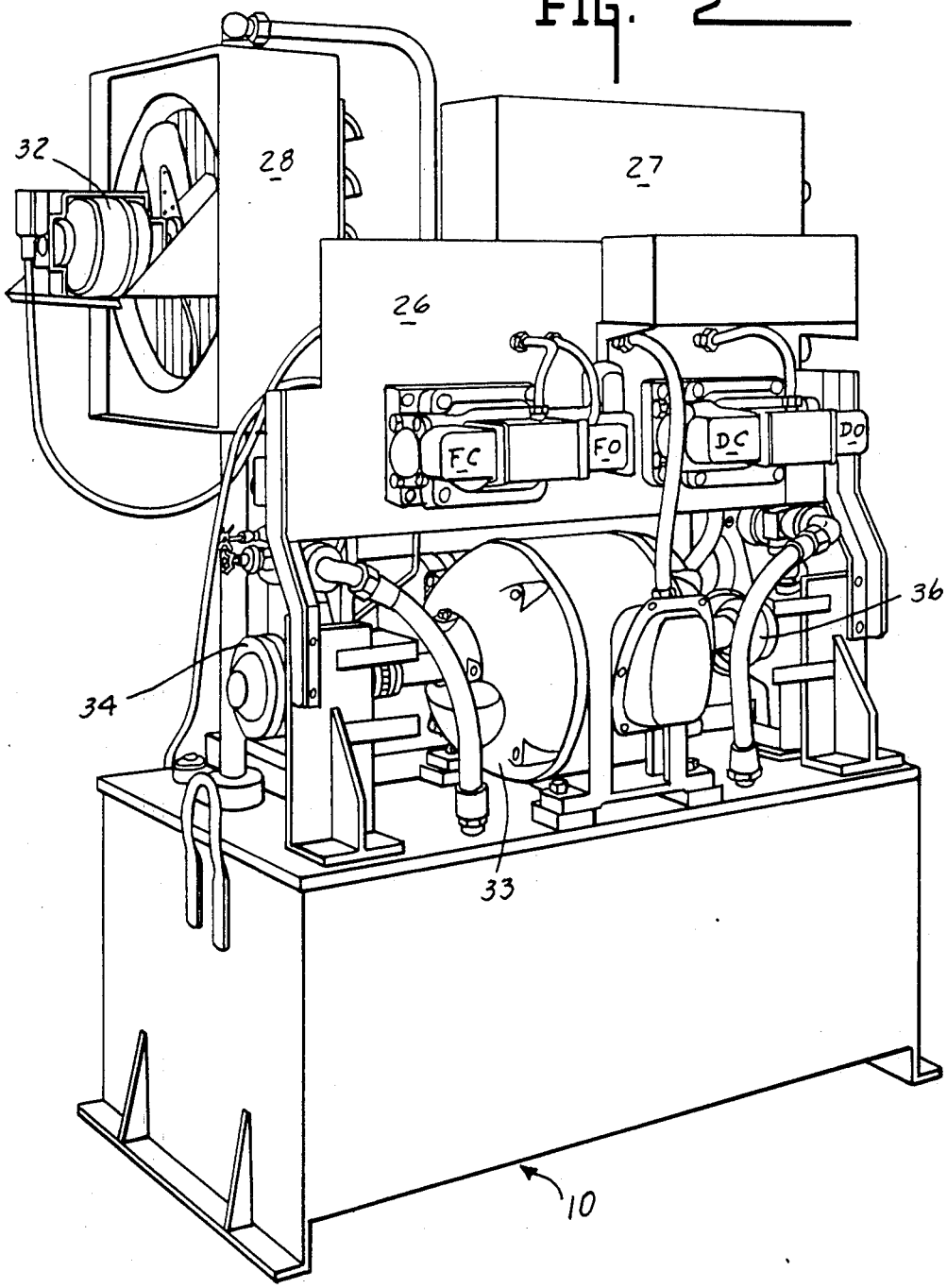
FIG. 2 is a further perspective view but taken from the opposite side of the apparatus.

Referring initially to FIGS. 1 and 2, the reference numeral 10 generally designates a rectangular base or frame which houses a hydraulic fluid reservoir, not shown. Mounted on one side of the tank is an oil reservoir 11 having a flush pump motor 12 supported thereon. The motor serves to pump oil through the line 13 into the stock receiving head, generally designated at 14 and after moving through the head, the flushed oil accumulates in the receptacle 16 and runs through the tube 17 and filter screen 18 back to the oil reservoir 11. Extending from the stock receiving head 14 is a hydraulic cylinder 51. The cylinder serves to actuate certain components of the head 14 as will be explained in detail with reference to FIGS. 3–5. Extending from the cylinder are hydraulic lines 19, 21, 22 and 23. The hydraulic lines extend to a panel 24 and are connected by means of further hydraulic lines to control valves in a conventional manner.

Atop the vertically extending plate 26, there is mounted an electrical control box 27 having various push button switches thereon. Adjacent the control box there is mounted a heat exchanger 28 having an input line 29 for conducting hydraulic fluid thereto and an outlet line 31 for returning fluid to the hydraulic fluid reservoir.

As may best be seen in FIG. 2, the heat exchanger is provided with a motor driven fan 32 for moving cooling air therethrough. Mounted beside the hydraulic cylinder 51 is a motor 33 whose shaft operates hydraulic fluid pumps 34 and 36 through suitable couplings. The motor and pumps thus serve to provide hydraulic pressure for the cylinder 51.

Figure 3:
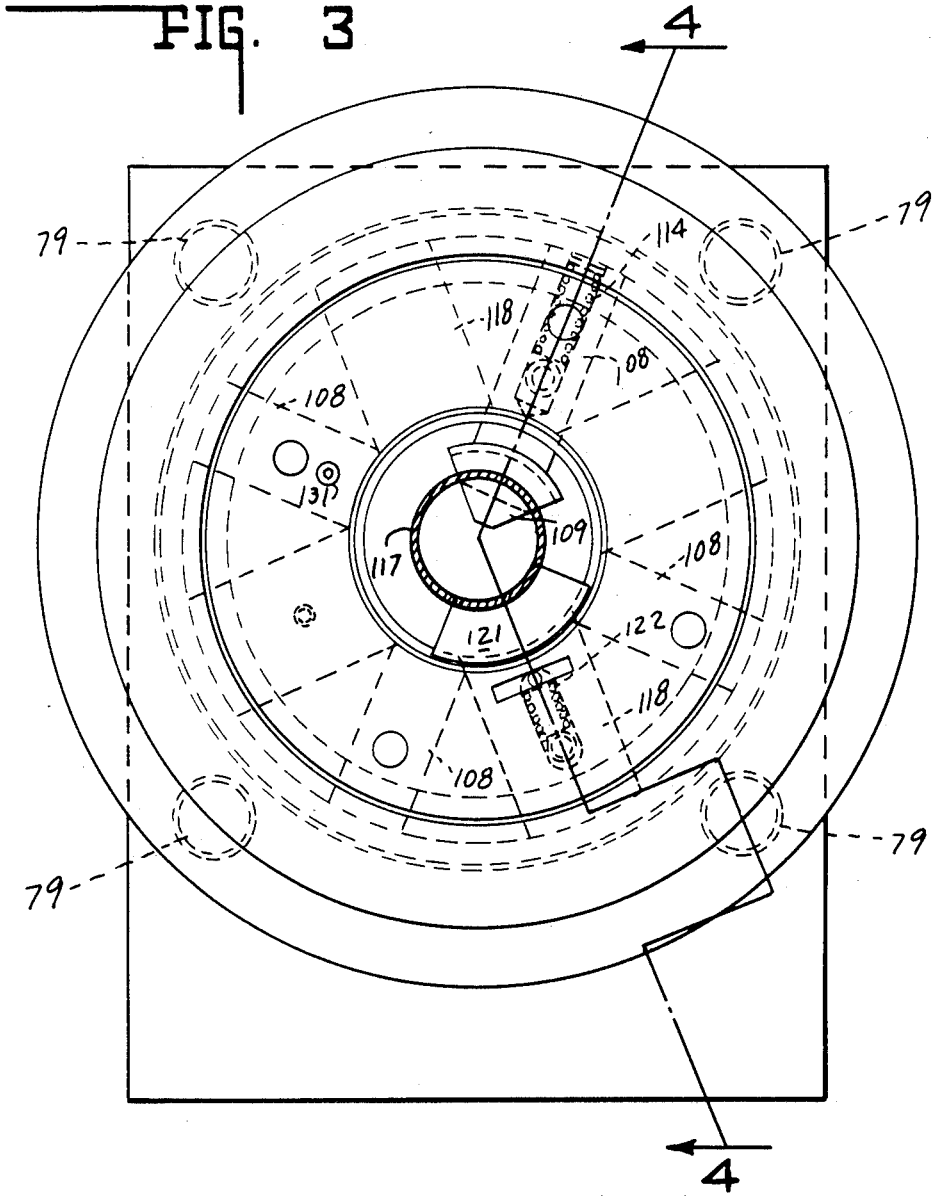
FIG. 3 is an end view of the stock receiving head of the apparatus.
Figure 4:
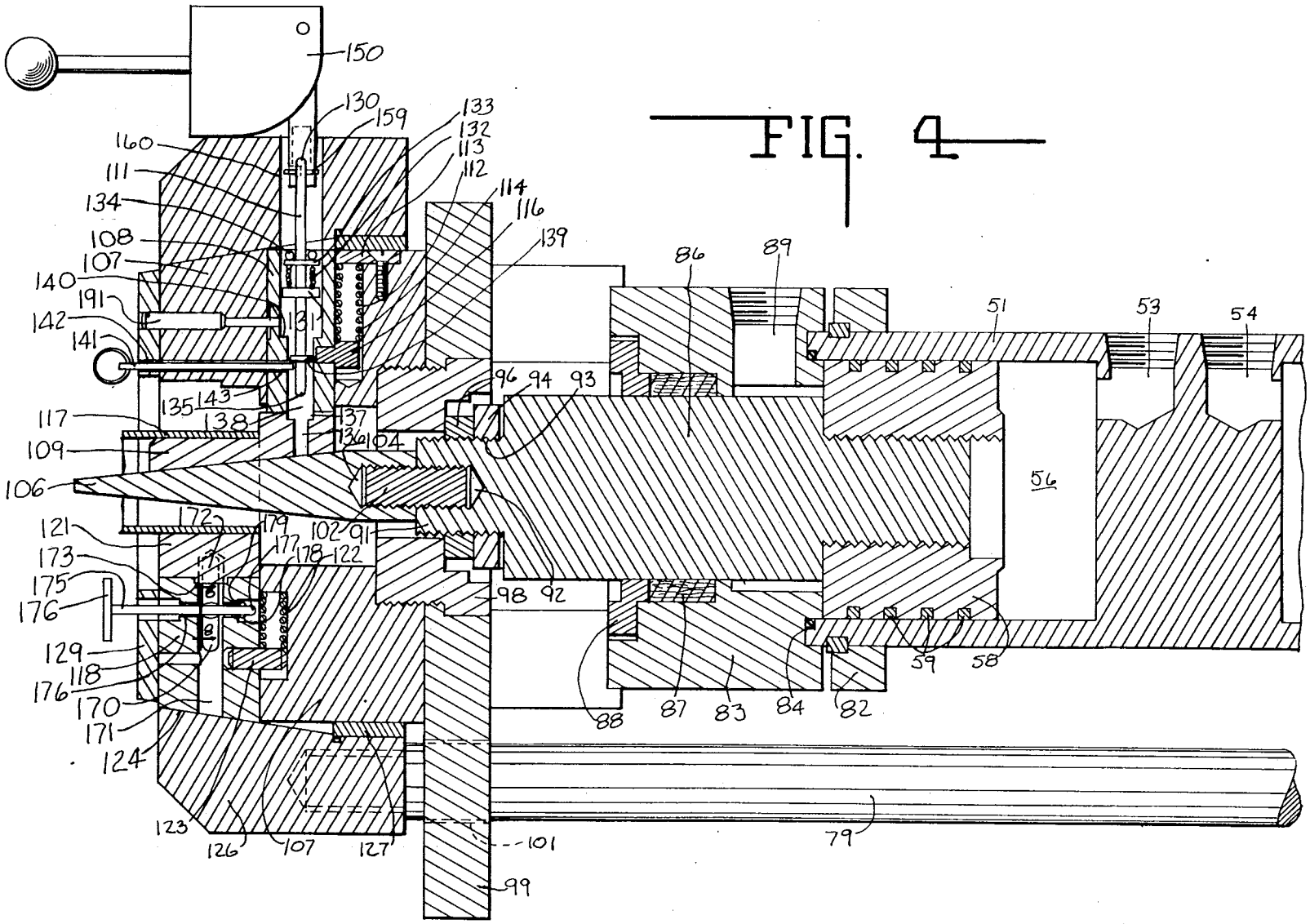
FIG. 4 is a sectional view taken generally along the line 4—4 of FIG. 3.
Figure 5:
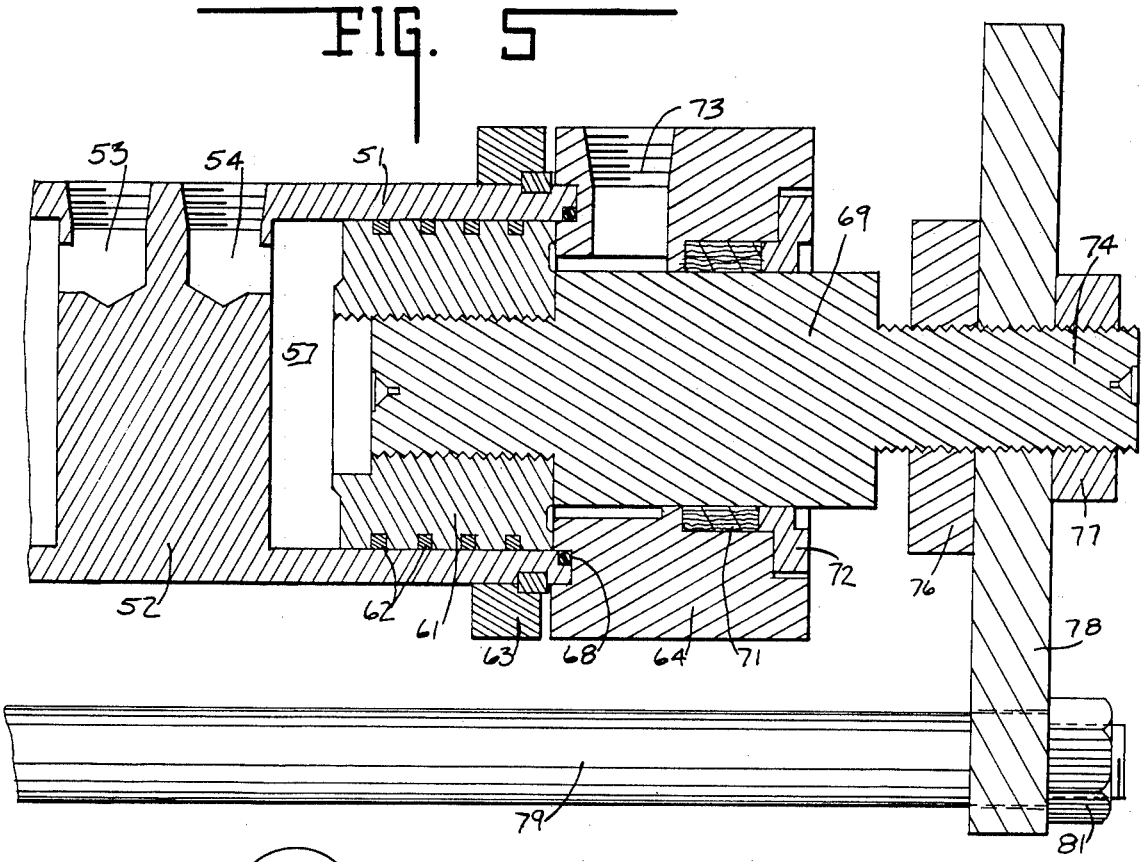
FIG. 5 is a sectional view which represents an extension of the sectional view shown in FIG. 4.

Referring now to FIGS. 3, 4 and 5, the work accommodating head and the hydraulic actuating means therefor will be described. The actuating means includes a cylinder 51, the left-hand portion of the cylinder being shown in FIG. 4 and the right-hand portion thereof being shown in FIG. 5. The cylinder is divided centrally by a wall 52 and the wall is provided with adjacent apertures 53 and 54. The aperture 53 communicates with the cylinder bore 56 and the aperture 54 communicates with the cylinder bore 57 to permit access of hydraulic fluid thereto. Movable within the bore 56 is a piston 58 provided with suitable piston rings 59. The bore 57 accommodates a similar piston 61 provided with piston rings 62. The outer end of the cylinder, shown in FIG. 5 has rigidly secured thereto an annular member 63 and is closed by a member 64 having a central aperture therein. The member 64 is rigidly held in sealed relation to the end of the cylinder by means of screws 66 (FIG. 1), the annular seal 68 providing a fluid-tight junction.

A piston shaft 69 has a reduced end threaded into and thereby rigidly secured to the piston 61. The shaft 69 extends through the central aperture in the member 64 and is movable therein, a hydraulic seal 71 and a bronze bushing 72 being provided therefor. An aperture 73 in the member 64 communicates with the area surrounding the central section of the shaft 69 and provides access for hydraulic fluid to the rear face of the piston 61. The reduced outer end 74 of the shaft 69 is threaded to accommodate locking nuts 76 and 77 which fix the position of a plate 78 upon the shaft. The plate 78 is rectangular in configuration and is provided with apertures adjacent its corners to accommodate thrust rods 79, the rods being secured to the plate 78 by means of nuts 81. While only one of the rods 79 is shown in FIG. 5 for purposes of clarity, the general disposition of the rods will be apparent from FIG. 1. From the foregoing, it will be apparent that by controlling the hydraulic pressure on opposite sides of the piston 61, the plate 78, and consequently the thrust rods 79, may be positionally controlled.

Referring now to FIG. 4, it may be seen that the opposite end of the cylinder 51 is provided with an annular member 82 which receives machine screws similar to screws 66 of FIG. 1, the screws serving to mount and seal the member 83 upon the open end of the cylinder. The sealing member 84 is a counterpart of the seal 68 in FIG. 5. The piston 58 is rigidly attached to a reduced end of the piston shaft 86 which extends through a central aperture in the member 83 and cooperates with the hydraulic seal 87 and the bronze bushing 88. The member 83 is provided with an aperture 89 which communicates with the area adjacent the enlarged central portion of the piston shaft 86 and provides for access of hydraulic fluid to the rear face of the piston 58.

The outer end of the shaft 86 is reduced, as indicated at 91 and is provided with a tapped bore 92 and external threads 93. The externally threaded end of the shaft accommodates nuts 94 and 96 which may be adjustably positioned and locked along the reduced end 91 of the shaft. The nut 96 is adapted to engage an internal shoulder formed in a stop member 98 rigidly mounted in a central opening in a stationary plate 99. Plate 99 is provided with apertures 101 which freely accommodate the thrust rods 79. It will be evident from FIG. 4, that by controlling the hydraulic pressures on the opposite faces of the piston 58, the position of shaft 86 may be controlled. Engagement of the nut 96 with the stop member 98 serves to establish the other limit of the movement of the shaft 86, this limit being adjustable for positioning of the nut 96 on the reduced end portion of the shaft.

The head for accommdating the work or tube stock will now be described with reference to FIGS. 3 and 4. The bore 92 in the shaft 86 accommodates an externally threaded member 102 which is also threaded into an axial aperture 104 in a tapered mandrel 106. The mandrel 106 is thus rigidly attached to and movable with the shaft 86. Threaded upon the stop member 98 is a stationary annular member 107. As may best be seen in the upper portion of FIG. 4, the annular member 107 is provided with a series of equally spaced, radial apertures, each of which slidably accommodates a casing or pin 108. The inner ends of the pins are each provided with forwardly projecting fingers or arbor members 109, the members 109 being joined to the pins 108 by means of quick disconnect members 111. The stationary member 107 is provided with a radial aperture 112 adjacent each of the pins, the apertures being closed by plates 113. Compression springs 114 are disposed within the apertures 112 and at their upper ends bear against the plates 113 and, at their lower ends, bottom against members 116 which are carried by the pins 108. It will thus be evident that the arbor members 109 are biased toward the axial center line of the head by the springs 114 and are moved upwardly by engagement with the tapered mandrel 106. With a section of tube stock, indicated at 117, disposed over the arbor members, the members 109 will be urged against the inner circumference of the tube stock in proportion to the positioning of the mandrel 106. For purposes of clarity, only one of the arbor members 109 is shown in FIG. 4, although it will be understood that multiple members are carried by the member 107.

Quick disconnect members 111 have a pin shaped main body 130 with an enlarged portion 131 located intermediate the ends of the main body forming a shoulder upon which a helical spring 132 rests. The top end of spring 132 abuts against the underside of washer 133 mounted to pin 130 with the washer being urged against a pair of pins 134 fixedly secured to casing 108. Thus, spring 132 urges pin 130 downwardly until the bottom end 135 of the pin extends into hole 136 of arbor member 109 locking the arbor member to casing 108. Hole 136 is provided with a counter bore 137 aligned with hole 138 extending through casing 108. An enlarged portion of pin 130 forms shoulder 139 and is sized to be received in counter bore 137 when the pin is in the downward position. Hole 138 is enlarged above shoulder 140 to allow enlarged portion 131, helical spring 132 and washer 133 to slide freely within hole 138.

In order to remove arbor members 109, the pin is pulled to the upward position as depicted to FIG. 4. An elongated member or rod 141 is extended through holes 142 and 143 provided respectively in annular member 107 and casing 108. Elongated member 141 may be positioned immediately against and beneath shoulder 139 holding the pin in the upward position. In order to secure the arbor member 109 to casing 108, elongated member 141 is pulled outwardly allowing the helical spring to force the pin downwardly into hole 136.

Figure 6:
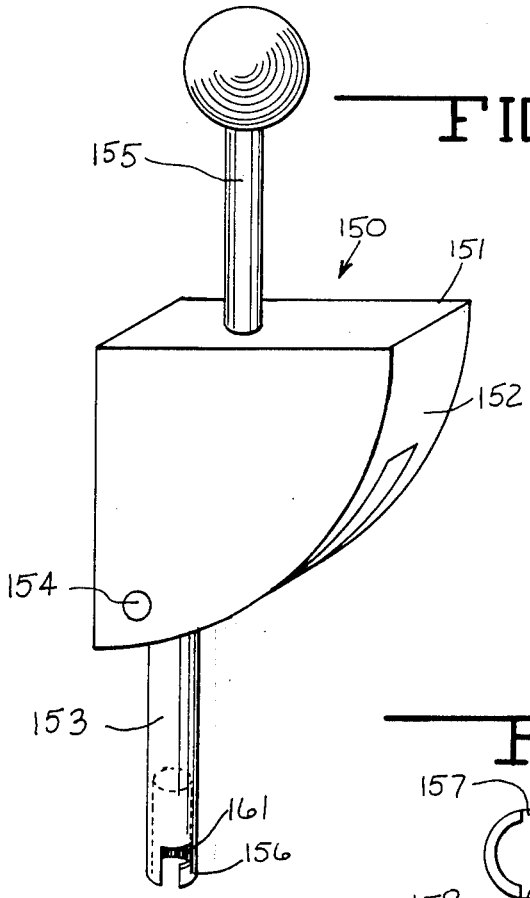
FIG. 6 is a perspective view of a tool to remove the arbor members.
Figure 7:
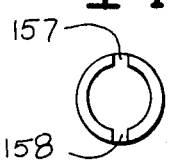
FIG. 7 is a bottom view of the shank of the tool shown in FIG. 6.

Tool 150 (FIG. 6) is provided to allow the operator to pull pins 130 to the upward position. The tool (FIG. 5) includes a main body 151 with an arcuate cam surface 152 and a depending hollow cylinder 153 pivotally mounted thereto by pin 154. A handle 155 is fixedly attached to the main body and extends upwardly therefrom. The bottom end 156 of cylinder 153 includes a pair of aligned slots 157 and 158 (FIG. 7) which are sized to receive pin 159 (FIG. 4) fixedly secured to the top end of pin 130. Thus, to move pin 130 to the upward position, cylinder 153 is extended through hole 160 of annular member 126 (FIG. 4) and into hole 138 of casing 108 until pin 159 enters slots 157 and 158. Cylinder 153 may then be rotated until pin 159 enters the offset slots 161 (FIG. 6) in communication with slots 157 and 158 thereby locking pin 159 to cylinder 153. Handle 155 may then be pivoted to the left as viewed in FIG. 4 with cam surface 152 contacting the outer surface of annular member 126 thereby pulling the pin upwardly until elongated member 141 is positioned beneath shoulder 139. In order to relock the casing to the arbor member, the process is repeated and tool 150 is removed.

Figure 8:
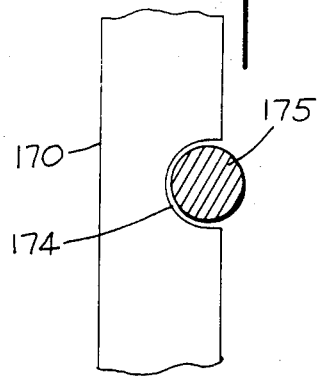
FIG. 8 is an enlarged cross-sectional view taken along the line 8—8 of FIG. 4 and viewed in the direction of the arrows.

The stationary member 107 is further provided with an additional series of equally spaced radial apertures slidably accomodating housings 118. Each housing 118 includes a hole 171 extending therethrough and having the top end 173 of hole 171 enlarged to receive the downwardly extending projection 172 provided on arcuate die head 121. A pin 170 is fixedly mounted to projection 172 and extends freely into hole 171. A recess 174 is provided in pin 170 (FIG. 8) to receive the shank 175 of tool 176 extending freely through front ring 129 and into hold 176 being arranged perpendicular to hole 171 and extending through pin 170. The inner end 177 of shank 175 includes a pair of spring biased ball bearings 178 which engage stop surface 179 of the enlarged end of the hole 176 thereby securing the tool within the hole until the handle is grasped and pulled outwardly. Thus, when tool 176 is mounted to pin 170 and extending through recess 174, the die head 121 is locked to the pin whereas removal of the tool 176 allows for the removal or separation of the die head 121 from housing 118.

Adjacent each of the housings 118, the stationary member 107 is formed so as to accommodate compression springs 122 which bear against sidewardly extending members 123 carried by the housings 118. The housings 118 are thus urged radially outwardly from the axial center line of the assembly by the springs 122. For purposes of clarity, only one of the die heads 121 is shown in FIG. 4, although it will be understood that multiple heads are carried by the member 107.

At their outer ends the housings 118 are provided with inclined faces which are slidably engaged by the inner tapered wall 124 of an outer, annular member 126. The member 126 is provided with a bronze bearing ring or bushing 127 and receives the threaded ends of the thrust rods 79. A front ring 129 attached to the face of the stationary member 107 by means of machine screws 191 completes the assembly.

As shown in FIGS. 4 and 5, the piston 61, and consequently the annular member 126, are in their extreme rightward or retracted position, and the housings 118 are thereby disposed in their maximum inward positions and against the tube stock 117. Shifting of the position of the piston 61 leftwardly, as viewed in FIG. 5, serves to correspondingly shift the position of the member 126 to permit the die members 121 to withdraw from the outer surface of the tube stock 117. Similarly, application of hydraulic pressure to the leftward face of the piston 58 will shift the mandrel 106 from its extreme leftward position of FIG. 4. Such shifting of the mandrel permits the arbor members 109 to retreat from the inner circumference of the tube stock 117.

In one embodiment, the hydraulic system and electrical circuitry utilized to operate the tube stock sizing apparatus is conventional in nature and is described in U.S. Pat. No. 3,049,034 which is herewith incorporated by reference. Suffice it to say that controls are provided for either manually or automatically sizing tube stock by accurately controlling the movement of pistons 58 and 61. The apparatus disclosed herein is identical to that disclosed in U.S. Pat. No. 3,049,034 with the exception that the apparatus disclosed herein is provided with quick disconnect mounting means for securing the arbor members and die heads.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A tube stock sizing apparatus comprising a stationary annular member, a plurality of spaced finger members for movement toward and away from the central axis of the annular member and spring biased toward said axis, said finger members extending parallel to the annular member axis with their outer surfaces being adapted to engage the inner bore of a section of tube stock to be sized, the inner surfaces of said finger members being inclined, spring biased quick disconnect means releasably engageable with said finger members and operable to mount said finger members to said annular member, a tapered spindle extending centrally through said finger members and engaging the inclined inner surfaces thereof, said spindle being movable along the axis of said annular member to displace said finger elements outwardly therefrom and into engagement with the tube stock, a plurality of spaced die elements for movement toward and away from the central axis of the annular member and spring biased away from said axis, the inner surfaces of said die elements being adapted to engage the outer surface of a section of tube stock to be sized, the outer surfaces of said die elements being inclined, removable tool means releasably engageable with said die elements and operable to mount said die elements to said annular members, a ring member encircling said annular member and having an inclined inner surface engaging the inclined outer surfaces of said die elements, said ring member being movable along the axis of said annular member to displace said die elements inwardly toward said axis and into engagement with the tube stock, and means for moving said spindle and said ring member independently of each other, said means comprising a hydraulic cylinder centrally divided into a first and second working chamber and mounted coaxially with said stationary annular member, a piston in said first chamber having an operative connection to said spindle, a piston in said second chamber having an operative connection to said ring member.

2. A tube stock sizing apparatus with quick disconnect arbor and die heads comprising:

a stationary annular member with a central, longitudinally extending axis;

a plurality of spaced arbor members mounted to said annular member and spring biased for movement toward the central axis of the annular member and having outwardly facing surfaces adapted to engage the inner bore of a section of tube stock to be sized;

pin means mounted to said annular member and spring biased into said arbor members to secure said arbor members to said annular member but yieldable to allow disengagement from said annular member and unmounting of said arbor members from said annular member;

a plurality of die heads mounted to said annular member and spring biased for movement away from the central axis of the annular member and having engaging surfaces adapted to engage the outer surface of a section of tube stock to be sized;

removable elongated member means extending longitudinally in the direction of said axis and being releasably mounted to said die heads to hold at least a portion thereof to said annular member;

a tapered spindle extending centrally through said arbor members and engaging the inwardly facing surfaces thereof, said spindle being movable along the axis of said annular member to displace said arbor members outwardly therefrom and into engagement with the tube stock; and, a ring member encircling said annular member and having an inner surface engaging said die heads and being movable along the axis of said annular member to displace said die heads inwardly toward said axis and into engagement with the tube stock.

3. The tube stock apparatus of claim 2 wherein:

said pin means includes a pin shaped main body and a helical spring encircling said main body urging said pin shaped main body into engagement with one of said arbor members but yieldable when said pin shaped main body is pulled away from said one arbor member.

4. The tube stock apparatus of claim 3 wherein:

said pin shaped main body includes an outer end with a tool engageable projection thereon.

5. The tube stock apparatus of claim 3 wherein:

said pin shaped main body has a first stop means and a second means thereon, said first stop means contacts said one arbor member when said pin shaped main body extends therein limiting further inward movement relative to said arbor member, said second stop means contacts said helical spring and provides a shoulder for said spring to rest upon;

said pin means includes third stop means contacting an end of said spring opposite said second stop means to secure said spring between said second and third stop means allowing movement of said pin shaped main body in a direction from said annular member toward said arbor member and back;

a rod extendable into said annular member and engageable with said first stop means when said pin shaped main body is pulled away from said one arbor member, said rod holds said pin shaped main body away from said one arbor member when inserted in said annular member.

6. The tube stock apparatus of claim 5 wherein:

said die heads each include a housing body and a tube stock engaging body secured together, said housing body has a hole with an enlarged end adjacent said tube stock engaging body which in turn has an outwardly extending projection fittingly received by each enlarged end, said tube stock engaging body further has a leg mounted to said projection and extending into said hole with said leg having a recess, said removble elongated member means extends into each recess holding said tube stock engaging body to said housing body, said elongated member means having a shank with spring biased projections releasably engageable with said die heads limiting accidental disengagement of said shank therefrom.

7. A tube stock sizing apparatus comprising a stationary annular member, a plurality of spaced finger members supported by said annular member for movement toward and away from the central axis of the annular member, said finger members extending parallel to the annular member axis with their outer surfaces being adapted to engage the inner bore of a section of tube stock to be sized, the inner surfaces of said finger members being inclined, a tapered spindle element extending centrally through said finger members and engaging the inclined inner surfaces thereof, said spindle element being movable along the axis of said annular member to displace said finger elements outwardly therefrom and into engagement with the tube stock, a plurality of spaced die elements supported by said annular member for movement toward and away from the central axis of the annular member, said die members having legs with recesses, the inner surfaces of said die elements being adapted to engage the outer surface of a section of tube stock to be sized, the outer surfaces of said die elements being inclined, elongated rods extending longitudinally in the direction of said axis and into said recesses releasably securing said die heads to said annular member, a ring member encircling said annular member and adapted to engage the inclined outer surfaces of said die elements, said ring member being movable along the axis of said annular member to displace said die elements inwardly toward said axis and into engagement with the tube stock, means for moving said spindle element and said ring member independently of each other, said means comprising a dual hydraulic cylinder, spring biased pins mounted to said annular member and normally urged into engagement with said finger members securing same thereto but yieldable to allow unmounting of said finger members from said annular member, rod means engageable with said spring biased pins to hold same away from said finger members.

* * * * *